United States Patent [19]

Ikeda

[11] Patent Number: 4,520,238

[45] Date of Patent: May 28, 1985

[54] PICKUP DEVICE FOR PICKING UP VIBRATION TRANSMITTED THROUGH BONES

[75] Inventor: Yasuo Ikeda, Oiso, Japan

[73] Assignee: Pilot Man-Nen-Hitsu Kabushiki Kaisha, Tokyo, Japan

[21] Appl. No.: 552,246

[22] Filed: Nov. 16, 1983

[30] Foreign Application Priority Data

Nov. 16, 1982 [JP] Japan ..... 57-172389[U]
Nov. 19, 1982 [JP] Japan ..... 57-174340[U]

[51] Int. Cl.[3] ..... H04R 1/46

[52] U.S. Cl. ..... 179/121 C; 179/107 S; 381/91

[58] Field of Search ..... 179/121 C, 107 S, 107 BC; 181/91

[56] References Cited

U.S. PATENT DOCUMENTS 4,150,262 4/1979 Ono ..... 179/102

FOREIGN PATENT DOCUMENTS 55-93395 7/1980 Japan ..... 179/121 C

*Primary Examiner*—Gene Z. Rubinson
*Assistant Examiner*—L. C. Schroeder
*Attorney, Agent, or Firm*—Wenderoth, Lind & Ponack

[57] ABSTRACT

A pickup device for picking up sound generated by the vocal chords and transmitted through bones from the nasal bone. A microphone (11) is mounted on or embedded into an eyeglass-like assembly (13, 15). When the microphone is mounted as a nosepiece, it is made into direct contact with the nose so that it directly picks up vibration transmitted through the nasal bone. When the microphone is mounted on the eyeglass-like frame or embedded therein, it picks up vibration transmitted through the nosepieces and eyeglass-like frame. A cord (12) whose one end is electrically connected to the microphone is held by holding member extended from the eyeglass-like assembly (13, 15) so that the transmission of mechanical vibration to the microphone is prevented.

18 Claims, 31 Drawing Figures

PICKUP DEVICE FOR PICKING UP VIBRATION TRANSMITTED THROUGH BONES

BACKGROUND OF THE INVENTION

The present invention relates to a pickup device for picking up the audio signal transmitted through the nasal bone as the solid vibration.

The audio signals are transmitted through various parts of a face. That is, they are transmitted through the forehead, nose, hard bones immediately behind ears, the bones below the cheek and so on. Of these signals, the audio signal transmitted from the nasal bone has high tone quality and a high gain. Especially, the audio signal transmitted from the right and left sides of the nasal bone (hard bone) is optimum in tone quality and gain. The portions from which such high tone quality and gain audio signal can be picked up correspond to the portions of the nose against which are pressed the nosepieces of eyeglasses. The high frequency range of the audio signal picked up from the ridge of the nasal bone (hard bone) tends to be damped. The gain of the audio signal picked up from the soft bone of the nose is relatively high, but the high frequency range is also damped. Therefore it follows that the pickup device must be worn in such a way that the nosepieces are pressed against the right and left sides of the nose (hard bone) in a stable manner. Furthermore, the pickup device must be easy to wear or remove. There have been proposed various types of pickup devices for picking up vibration or audio signal transmitted through the nasal bone, but they are not satisfactory in practice. That is, sweats, body oil, toilet compounds and medical compounds are made into contact with the nose. Furthermore, it is difficult to design and construct a microphone, which can be detachably worn by each individual, depending upon the bone structure of each individual. Moreover, a cord is needed to transmit the electrical signal generated in a microphone, but there has not been available suitable means for supporting the cord.

SUMMARY OF THE INVENTION

One of the objects of the present invention is therefore to provide a pickup device for picking up sound or vibration transmitted through the nasal bone from one side or both sides of the nose.

Another object of the present invention is to provide a pickup device adapted to pick up sound or vibration transmitted through the nasal bone from one side or both sides of the nose regardless of the differences in bone structure of the faces.

A further object of the present invention is to provide a pickup device capable of picking up sound or vibration transmitted through the nasal bone from one side or both sides of the nose regardless of the random motion of the head.

Yet another object of the present invention is to provide a pickup device capable of picking up only sound or vibration transmitted through the nasal bone by suppressing noise not transmitted through the bones.

The above and other objects, effects, features and advantages of the present invention will become more apparent from the following description of preferred embodiments thereof taken in conjunction with the accompanying drawings.

BRIEF DESCRIPTION OF THE DRAWINGS

In the accompanying drawings

DESCRIPTION OF THE PREFERRED EMBODIMENTS

Figure 1:
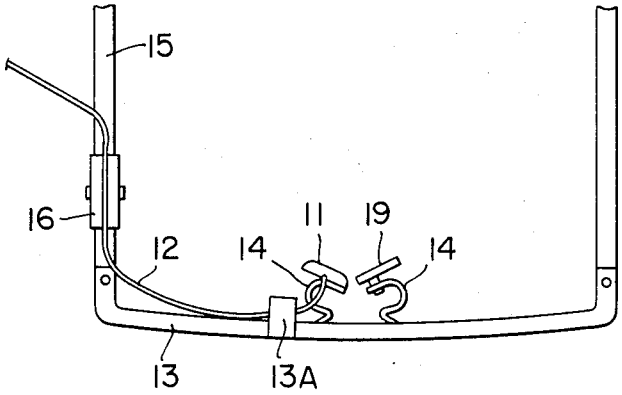
FIG. 1 is a top view of a first embodiment of a pickup device in accordance with the present invention.

This invention relates to an eyeglass-like pickup device comprising a solid vibration pickup microphone fitted to an eyeglass-like assembly. The solid vibration pickup according to this invention directly picks up an audio signal transmitted through bones as a solid vibration, thereby enabling the pickup device to convert the audio signal into an electrical signal.

The eyeglass-like assembly used for this invention basically comprises a face-opposing member, a nosepiece and supporting members, the latter two enabling the face-opposing member to stably rest on the nose, at least its either side, and the ears respectively. If necessary, auxiliary accessories including spectacle lens can be applicable.

The present invention thus constituted can have a solid vibration-picking up microphone as the nosepiece or incorporate the microphone in the nosepiece, face-opposing member, or supporting members thereby allowing a direct pickup of an audio signal transmitted through bones as a solid vibration. The picked up signal is sent to a microphone to convert the signal into an electrical signal and to output the electrical signal through a flexible cord connected to the face-opposing member.

According to the present invention, the nosepiece is made into intimate contact with the nose so that the pickup device may be stably held in position. In addition, it has a function of pick up the audio signal transmitted through bones at a high tone quality and a high gain and in a stable manner.

Therefore, the nosepiece may be in the form of a projection which is extended from the face-opposing member and adapted to make into intimate contact with the nose. Alternatively, the nosepiece may be mounted on a holder which in turn is extended from the face-opposing member. The nosepiece may be rotatably mounted to make into intimate contact with at least one upper side portion of the nose.

Various embodiments can be possible in accordance with this invention. The microphone can be fitted, for example, to the face-opposing member in place of the nosepiece to directly pick up the audio signal from the nasal bone. The microphone in another example can be fitted to the nosepiece to pick up the audio signal from the nasal bone via the nosepiece. Another example is the fitting of the microphone to the face-opposing member directly. In this case, however, the audio signal is transmitted through the nosepiece and the face-opposing member. Still another application is the fitting of the microphone to the supporting member. In this case, again, the audio signal of interest is transmitted through the nosepiece, the face-opposing member and the supporting member. Still another example is that the face-opposing member is provided auxiliary accessories. In this case, the auxiliary accessory should be signal-conductive thereby enabling the nosepiece or the microphone per se fitted to the auxiliary accessory to pick up the audio signal. Of course, the audio signal thus transmitted in each example is available for pickup by the microphone.

A pair of corrective lenses may be or may not be mounted in the face-opposing member.

One ends of the supporting member which generally rest on ears may be hingedly or not hingedly connected to the ends of the frame which is placed in front of the eyes. The supporting member may be in the form of a string, plate or the like which is used in the conventional eyeglasses.

In other words, the supporting member is to support the face-opposing member to stably rest on the nose thereby assuring a safe touching of the nosepiece or the microphone to the nose.

Furthermore, when the head is moved violently, in order to securely hold the face-opposing member in front of the eyes and to securely maintain the contact between the nosepiece and the nose, the supporting members may be in the form of an elastic head band which surrounds the head.

It is important to hold the face-opposing member slightly apart from the face. Touching of the face opposing member to the face, except for the nosepiece and the support members, causes noise vibrations which deteriorate the S/N ratio when they are sent to the microphone. This is true with respect to the supporting members which are fitted to the both ends of the face-opposing member. Thus, the fitting of the microphone to a portion with a distance from the human face can assure the correct pickup of the audio signal transmitted through bones and collected by the nosepiece and the face-opposing member.

According to this invention, the tone quality and resultant signals differ depending upon where the microphone is placed. The nearer the micropone is to the nose, the more the tone quality and resultant signals become comprehensible. Under the circumstances where noises are extreme, auxiliary accessories such as lens should be minimized so as to reduce the adverse influence of outer noises and to increase the S/N ratio. To be more specific, under circumstances where the noise is exceeding the level of 100 dB, the face opposing member should be preferably free from lens and other accessories because they can be adversely affected by air vibration.

In addition to a piezoelectric element, FETs and resistors which are used for attaining the impedance matching may be incorporated into the case of the microphone. Alternatively, FETs and resistors may be housed in a separate case which is substantially equal in size to the case of the microphone and assembled with the latter as a unitary construction. Alternatively, the case in which are housed FETs and resistors may be mounted on the face-opposing member or the supporting members which rest on the ears.

The cord one end of which is electrically connected to the microphone is supported by a supporting means extended from the face-opposing member or the supporting member. Alternatively, it may be embedded into the face-opposing member and the supporting member.

Figure 2:
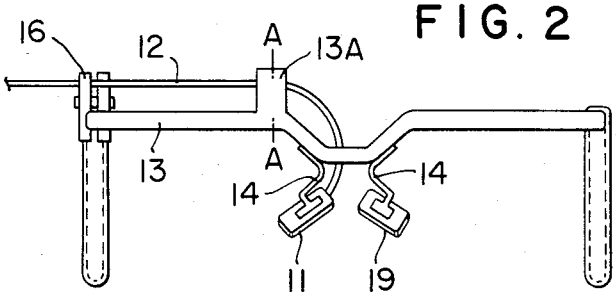
FIG. 2 is a front view thereof.
Figure 3:
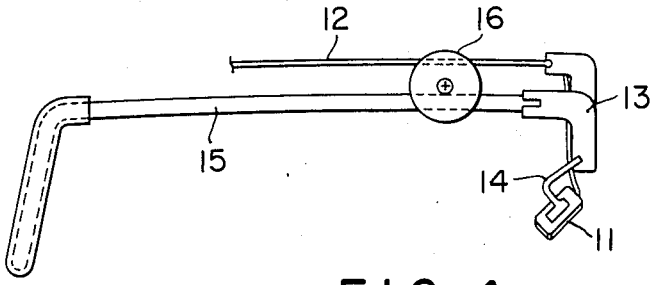
FIG. 3 is a side view thereof.

As shown in FIGS. 1–3, a microphone 11 is, at its flat portion, mounted on the flat portion of a holder 14 extended from a face-opposing member 13. Therefore, the microphone 11 used as one of the nosepieces. Another nosepiece 19 is mounted on another holder 14 as best shown in FIGS. 1 and 2.

A cord 12 is supported by a holding member 16 which in turn is mounted on a supporting member 15 which rests on the ear. The cord 12 is further held by a holding member 13A which is extended from the face-opposing member. Therefore, the eyebrows are not made into contact with the cord 12, no noise is induced in the cord 12.

Figure 2A:
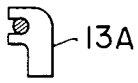
FIG. 2A is a cross sectional view taken along the line A—A of FIG. 2.

FIG. 2A is a sectional view taken along the line A—A of FIG. 2.

Figure 4:
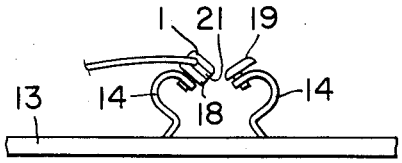
FIG. 4 is a partial top view of a second embodiment of a pickup device in accordance with the present invention.

A second embodiment as shown in FIG. 4 is substantially similar in construction to the first embodiment described above with reference to FIGS. 1-3, but a nosepiece 18 is rotatably mounted on the holder 14 and the microphone 11 is mounted on the nosepiece 18 through a vibration damping member 21.

Figure 5:
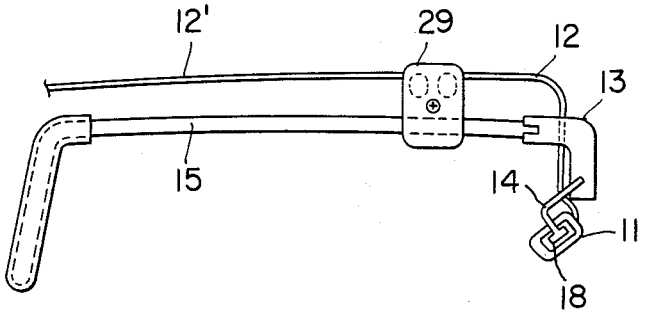
FIG. 5 is a side view of a third embodiment of the present invention.

In a third embodiment as shown in FIG. 5, the microphone 11 is mounted on the nosepiece 18 through the vibration damping member 21, the nosepiece 18 being mounted on the holder 14 extended from the face-opposing member 13.

A case 29 into which are housed a FET and a resistor is mounted on a supporting member 15 which rests on the ear. The case 29 and the microphone 11 are electrically interconnected by means of the cord 12 and another cord 12′ is extended from the case 29.

The case 29 (See FIG. 5) is so designed and constructed as to be substantially similar in size to the case of the microphone 11 and instead of the nosepiece 19, it may be mounted on the holder 14 extended from the face-opposing member 13.

Figure 6:
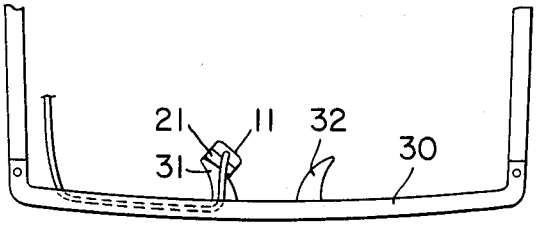
FIG. 6 is a top view of a fourth embodiment of a pickup device in accordance with the present invention.
Figure 7:
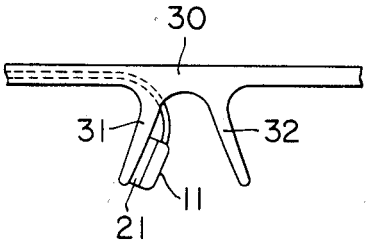
FIG. 7 is a front view thereof.

In a fourth embodiment as shown in FIGS. 6 and 7, the projection-like nosepiece 31 is extended from the face-opposing member 30 and the microphone 11 is mounted through the vibration damping member 21 on the nosepiece 31.

The microphone 11 which is in the form of one of a pair of nosepieces is made into direct contact with the nose and another nosepiece 32 is also made into intimate contact with the nose. As a result, the microphone 11 is made into intimate contact with the nose in a stable manner.

In the embodiments as shown in FIGS. 1 through 7, the microphone 11 can be maintained in stable contact with the nose under the weight of the face-opposing member. Face-opposing member without any special eyeglasses is needed so that the microphone may be mounted on eyeglasses or sun glasses used by an individual person. Even when the supporting members which rest on the ears are folded back on the face-opposing member, no adverse effect is imposed on the cord. In addition, one can hardly notice the microphone and the case into which are housed a FET and a resistor.

Figure 8:
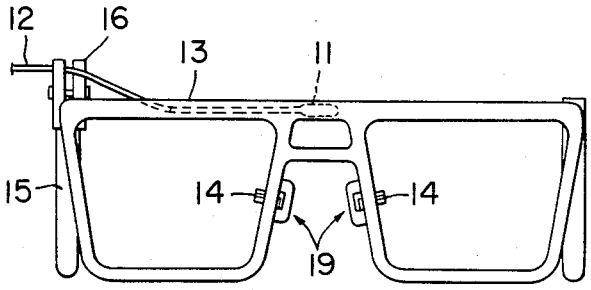
FIG. 8 is a front view of a fifth embodiment of a pickup device in accordance with the present invention.
Figure 9:
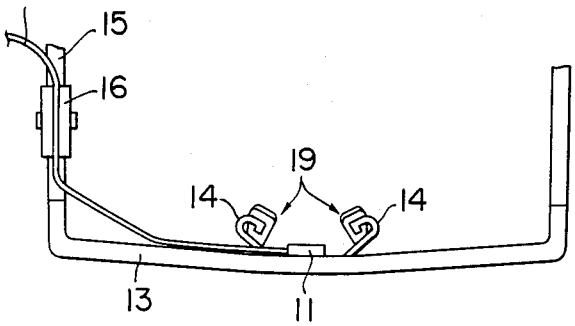
FIG. 9 is a top view thereof.
Figure 10:
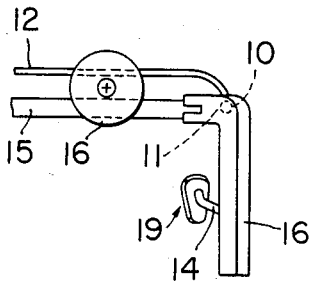
FIG. 10 is a side view of a sixth embodiment of a pickup device in accordance with the present invention.
Figure 11:
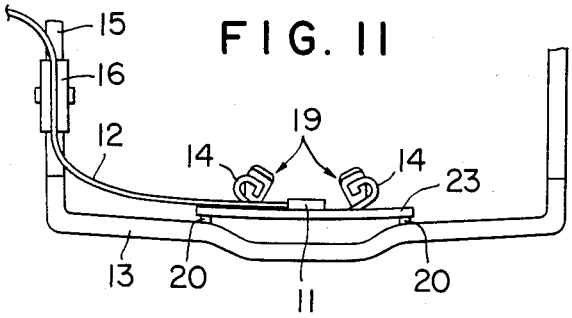
FIG. 11 is a top view of a seventh embodiment of a pickup device in accordance with the present invention.

In a fifth embodiment as shown in FIGS. 8 through 10, the pair of holders 14 are extended from the face-opposing member 13 and the microphone 11 is mounted on the face-opposing member 13 immediately above the pair of holders 14.

The nosepieces 19 are rotatably carried by the pair of holders 14.

The cord 12 is supported by the cord holding member 16 which in turn is mounted on the supporting member 15 which rests on the ear.

According to the embodiment as shown in FIGS. 8 through 10, a pickup device in accordance with the present invention can be provided without any modification of conventional eyeglasses just by mounting the microphone 11.

Figure 14:
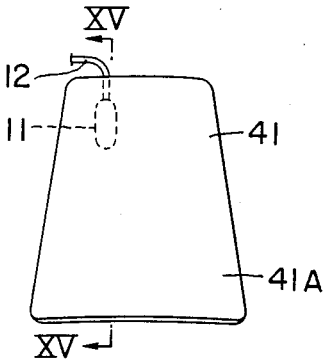
FIG. 14 is a front view of a soft pad used in a tenth embodiment of the present invention, a microphone being mounted on the soft pad.

In an embodiment as shown in FIG. 14, the nosepieces 19 are rotatably mounted on the pair of holders 14 which in turn are mounted on an auxiliary member or bridging member 23 which in turn are mounted on the face-supporting member 13 through the vibration damping members 20.

The microphone 11 is mounted on the inner surface of the auxiliary member or bridging member 23.

The cord 12 is supported by the cord holding member 16 which in turn is mounted on the supporting member 15.

Figure 13:
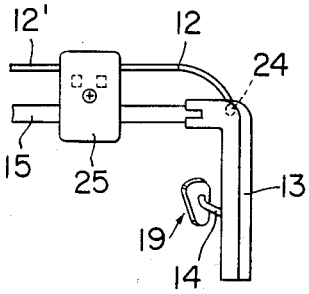
FIG. 13 is a side view of a ninth embodiment of a pickup device in accordance with the present invention.
Figure 12:
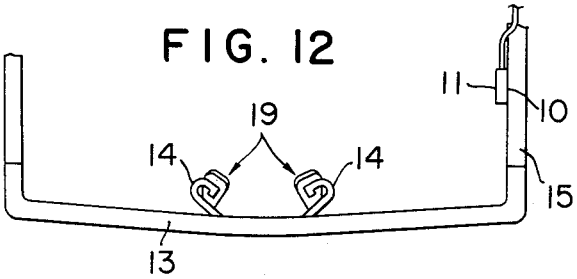
FIG. 12 is a top view of an eighth embodiment of a pickup device in accordance with the present invention.

An embodiment as shown in FIG. 13 is substantially similar in construction to the embodiment as described above with reference to FIGS. 8 through 10. Instead of the microphone 11, a microphone 24 is mounted on the face-opposing member 13.

A FET, a resistor and so on are housed in a case 25 which in turn is mounted on the supporting member 15. The case 25 and the microphone 24 is electrically interconnected with the cord 12 and the cord 12′ is extended from the case 25.

When the pair of eyeglasses are worn, the nosepieces 19 are made into intimate contact with the nose or nose and cheek. As a result, the audio signal transmitted through bones can be picked up by the microphone 24.

In the embodiments as shown in FIGS. 8 through 13, instead of the microphone, the nosepieces are made into intimate contact with the nose and the microphone picks up the audio signal which is transmitted through the nosepieces. Since the microphone is mounted on the face-opposing member, the nosepiece or the supporting member, the outer appearance of the pickup device may be considerably improved. Furthermore, the misalignment between the correcting lenses and the eyes may be substantially eliminated when the face-opposing member is lifted.

Figure 15:
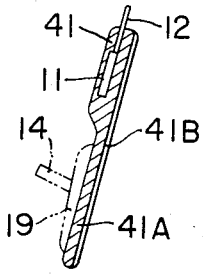
FIG. 15 is a cross sectional view thereof.
Figure 16:
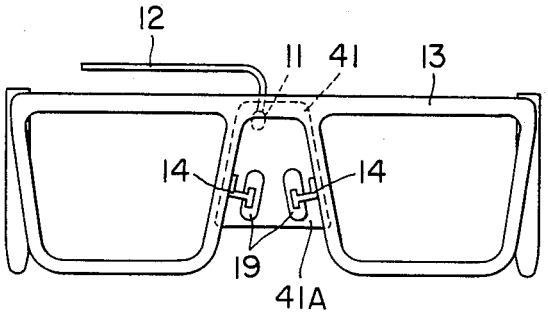
FIG. 16 is a front view of the tenth embodiment of the present invention.

In the embodiment as shown in FIGS. 14–16, a soft pad 41 has a lower thin-wall portion 41A and a portion 41B which is made into contact with the nose. The microphone 11 is embedded in a thick-wall portion; that is, the portion except the thin-wall portion 41A.

The nosepieces 19 are attached to the holders 14 extended from the face-opposing member 13.

One wears the pair of eyeglasses in such a way that the portion 41*b* in which is embedded the microphone 11 is made into contact with the side of the nose. In this case, the thin-wall portion 41A of the soft pad 41 is pressed against the nose by the nosepieces 19. The microphone 11 can pick up the audio signal transmitted through the nasal bone.

Adhesive tapes or the like may be interposed between the nosepieces 19 and the thin wall portion 41A of the soft pad so that the nosepieces 19 may be removably attached to the thin wall portion 41A of the soft pad 41.

Figure 17:
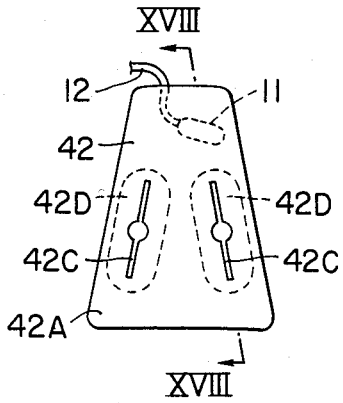
FIG. 17 is a front view of a soft pad used in an eleventh embodiment of the present invention, a microphone being mounted on the soft pad.
Figure 19:
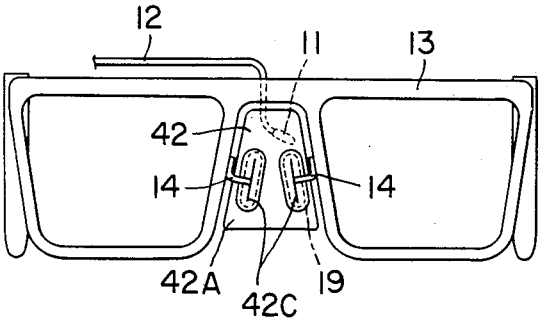
FIG. 19 is a front view of the eleventh embodiment of the present invention.
Figure 18:
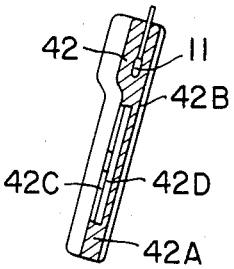
FIG. 18 is a cross sectional view thereof.

In the embodiment as shown in FIGS. 17–19, a soft pad 42 has a lower thin wall portion 44A and a portion 42B which is made into contact with the nose. The soft pad 42 is formed with apertures 42C through which are inserted the nosepieces 19 and pockets 42D into which are inserted or fitted the nosepieces 19. The pockets 42D are slightly larger in size than the nosepieces 19 in such a way that when the nosepieces 19 are inserted or fitted into the pockets 42D, they can move and consequently the pair of eyeglasses or the soft pad 42 may be located at an optimum position.

When the eyeglasses are worn, the nosepieces 19 are inserted through the apertures 42C into the pockets 42D, respectively, so that the soft pad 42 is pressed against the nose by the nosepieces 19. The microphone 11 picks up the audio signal transmitted through the nasal bone.

According to the embodiments as shown in FIGS. 14–19, the thin wall portion of the soft pad into which is embedded the microphone is pressed against the nose so that the soft pad can be maintained in a stable manner. In addition, since the thin wall portion is thin, the misalignment between the axes of the left and right eyes and the axes of the left and right lenses can be almost eliminated when the pair of eyeglasses is lifted. External noise vibration (air vibration) can be damped by the soft pad so that the microphone will not pick up noise.

According to the present invention, the soft pad is pressed against the nose in a stable manner by means of the nosepieces so that the microphone may be maintained in a stable manner. The cord which is electrically connected to the microphone is spaced apart from the face so that the cord may be prevented from being damaged by sweat, toilet goods or articles, chemicals and so on. Furthermore, because of the soft pad, external noise (air vibration) can be damped so that the microphone will not pick up external noise and consequently the S/N ratio can be improved.

The soft pad may be made of soft polyvinyl chloride, silicon rubber, urethane rubber, chloroprene rubber, natural rubber and foamed compounds. In order to make the soft pad snugly fit over the nose of a wearer, silicon plastics which are used for making molds of teeth or noise damping means to be fitted into the external ears and which are cured from a few minutes to tens of minutes are preferable.

Next the microphones used in the present invention will be described. In one microphone, a plug is fitted into a plug receiving member disposed at one end of a case which is filled with a viscous liquid and then one end is closed liquid-tightly. When the plug receiving member is in the form of a cylinder, the extreme end thereof is forced into intimate contact with the plug, whereby the case is closed. Alternatively, the plug is forced into intimate contact with the plug receiving member, whereby the case is closed. When the plug receiving member is in the form of a projection, the leading portion is pressed against the plug and the plug is made into intimate contact with the plug receiving member, whereby the case is closed.

The piezoelectric devices may be conventional ones such as barium titanate, lead zirconate or the like. Especially, bimorph is preferable. The piezoelectric devices may be in the form of a beam. Alternatively, they may consist of a beam of a metal, a plastic or a ceramic upon which a piezoelectric compound is bonded. The piezoelectric devices may be in any shape as long as they can be secured in position like a beam.

In the present invention, the piezoelectric devices include a metal, a plastic or a ceramic upon which is bonded a piezoelectric compound. The method for supporting the piezoelectric device is not related with the method for liquid-tightly sealing one end of the case so that the piezoelectric device may be supported in any suitable manner. For instance, the piezoelectric device may be supported like a cantilever.

Hard materials may be used for securely maintaining the piezoelectric device in position. It is especially preferable that the hard materials have a high degree of electric insulation. For instance, plastics, metals coated with an insulating material, ceramics may be used. However, it is necessary that they will not be chemically attacked by a viscous liquid or they will not adversely affect a viscous liquid. In order to maintain the piezoelectric device in position, it may be fitted into a recess or a hole of a maintaining member.

Only part of the piezoelectric device which vibrates may be immersed in a viscous liquid. Alternatively, the whole structure including the piezoelectric maintaining member or members may be immersed in a viscous liquid.

It is preferable that the cases are made of stainless steel or aluminum because stainless steel or aluminum is not chemically attacked by a viscous liquid, can be easily closed at one end and will not leak a viscous liquid. When a viscous liquid is suitably selected, the cases may be made of carbon steel or other plastic metals. If the above requirements can be met, plastics such as ABS resin may be used.

The plug may be made of metal, rubber, plastics, glass, ceramic because they are not chemically attacked by a viscous liquid. The plug may be in the form of a sphere, a column or a pyramid as long as it can liquid-tightly seal a plug receiving member.

It is preferable that a viscous liquid has the viscosity from 30 to 10,000 cs because a piezoelectric device is vibrated in the liquid and further because a resonant frequency at a predetermined value must be damped. It may be paraffin chloride, high molecular plastisizers, surface active agents, glycols, silicon oil, motor oil, mineral oils, organic solvents such as carbon hydrates or prepolymer such as urethane and epoxy resins. It is preferable that a viscous liquid used will not attack chemically and has a low volatility and is not toxic and has no odor. It is further preferable that a viscous liquid used exhibits less variation in volume and viscosity due to temperature.

One end of the case is first sealed and then the other end which receives a plug is sealed. Alternatively, the other end which receives a plug is first sealed and then one end of the case is sealed.

When a viscous liquid is filled into the case, the case filled with a viscous liquid is placed in a bell jar in such a way that the other end of the case which receives a plug is directed upwardly and the case is immersed into the body of a viscous liquid same as that filled into the case. The pressure in the bell jar is reduced and then returned to the atmospheric pressure. This decompression and compression process is repeated several to tens times so that the air trapped in the microphone case may be discharged while the viscous liquid is fully filled into the case. When a viscous liquid is filled into the microphone case, care must be exercised so that no air bubble is entrapped. To this end, the decompressed bell jar must be gradually returned to the normal atmospheric pressure.

Figure 19A:
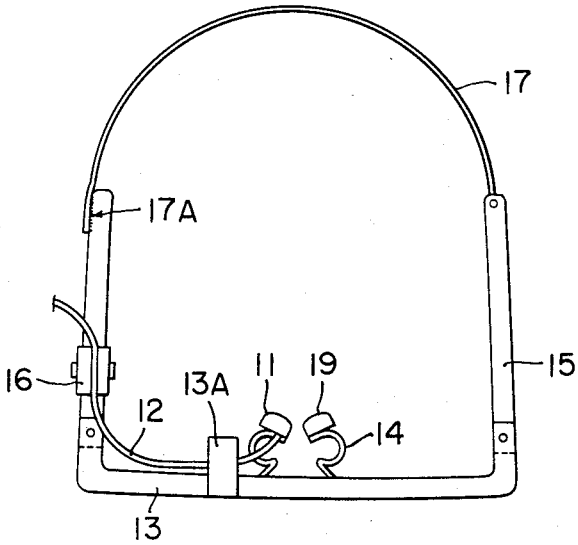
FIG. 19A is a top view of another embodiment of the present invention.

In an embodiment as shown in FIG. 19A, the pieces 15 are not adapted to rest on the ears and a head band 17 which is made of an elastic material is connected to the free ends of the pieces 15. The head band 17 maintains the face-opposing member 13 just in front of the eyes. For instance, one end of the head band 17 is securely fixed to the free end of one piece 15 while the other end of the head band 17 is terminated into a magic fastner 17A which is attached to the free end of the other piece 15.

Next referring to FIGS. 20–29, some of the embodiments of the microphones used in the present invention will be described.

Figure 20:
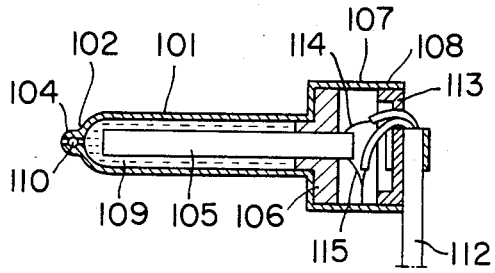
FIG. 20 is a longitudinal sectional view of a piezoelectric microphone used in the present invention.
Figure 21:
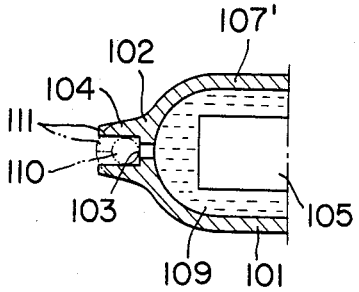
FIG. 21 is a fragmentary sectional view, on enlarged scale, thereof illustrating a method for sealing a viscous liquid in a case.
Figure 22:
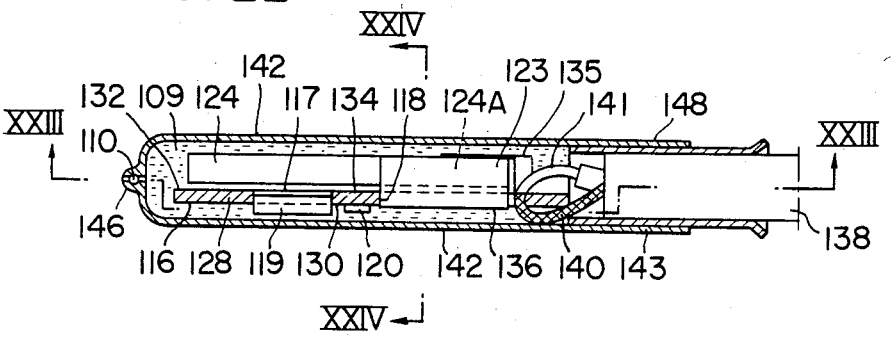
FIG. 22 is a longitudinal sectional view of another piezoelectric microphone used in the present invention.
Figure 23:
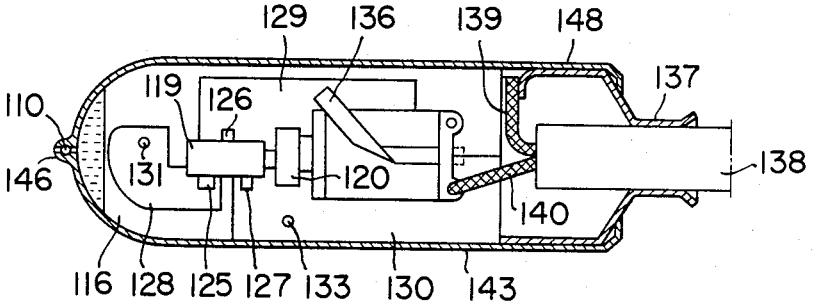
FIG. 23 is a sectional view taken along the line XXIII—XXIII of FIG. 22.

The embodiment as shown in FIGS. 20 and 21 includes a brass case 101 having an enlarged diameter portion 107 and a reduced diameter portion 107'. The end of the reduced diameter portion 107' is terminated into a cylindrical plug receiving member with a plug seat 103. A piezoelectric-element supporting member 106 which supports one end of a piezoelectric beam 105 is liquid-tightly attached to the bottom of the enlarged diameter portion 107. The end 108 of the case 101 is liquid-tightly sealed.

The case 101 is maintained in such a way that the plug receiving member 104 is directed upward and then a viscous liquid 109 is filled into the case 101. Thereafter a stainless steel plug in the form of a ball 110 is placed on the plug seat 103 of the plug receiving member 104. Thereafter while the plug 110 is pressed against the plug seat 103, the leading end of the plug receiving member 104 is calked, whereby the case 101 is liquid-tightly sealed. Lead wires 114 and 115 of the cord 112 are connected through a FET and a resistor (not shown) to the piezoelectric beam 105. The lead wire 115 is soldered to the enlarged diameter portion 107 of the case 101 so that the lead wire 115 is grounded. The end of the enlarged diameter portion 107 of the case 101 is sealed with a plug 113 upon which is mounted one end of the cord 112.

In order to ensure the positive liquid-tight seal of the inner end of the reduced diameter portion 107' of the case 101 with the element supporting member 106, a sealant such as silicon, a potting material, an O-ring or packing may be used.

In the embodiment as shown in FIGS. 22–25, a longitudinally extended base 116 is formed with two holes 117 and 118. A FET 119 is securely and snugly fitted into the hole 117 while a resistor 120 is securely attached to the outer surface of the base 116. An element supporting member 123 has a longitudinally extended recess 121 and a longitudinally extended ridge 122 (See FIG. 24). One end portion 124A of a piezoelectric beam 124 is snugly fitted into the recess 121 of the element supporting member 123 and the longitudinally extended ridge 122 is snugly fitted into the hole 118 of the base 116. Thus the piezoelectric beam 124 is spaced apart by a predetermined distance from the inner surface of the base 116.

The terminals 125, 126 and 127 of the FET 119 are electrically connected to conduction films or layers 128, 129 and 130, respectively, formed on the outer surface of the base 116 and the resistor 120 is connected to the conduction film or layer 129 and 130. The conduction film or layer 128 is electrically connected through a small aperture 131 to a conductor film or layer 132 formed over the inner surface of the base 116. The conduction film or layer 130 is electrically connected through an aperture 133 to a conduction film or layer 134 formed over the inner surface of the base 116. Lead plates 135 and 136 which are attached to the opposite surfaces of the end portion 124A of the piezoelectric beam 124 are electrically connected to the conduction films or layers 134 and 130, respectively.

A cord 138 is mounted on a brass cap 137 and a shielding wire 139 of the cord 138 is soldered to the inner surface of the cap 137 and is therefore grounded. The other shielding wire 140 and a lead wire 141 of the cord 138 are electrically connected to the conduction films or layers 129 and 132, respectively, of the base 116. A suitable filler such as an epoxy resin (not shown) is filled in the cap 137 so that the cap 137 may be liquid-tightly sealed.

Figure 24:
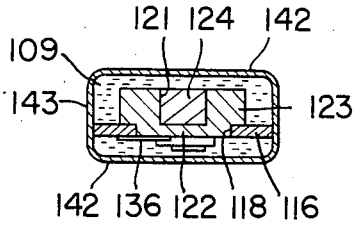
FIG. 24 is a cross sectional view taken along the line XXIV—XXIV of FIG. 22.
Figure 25:
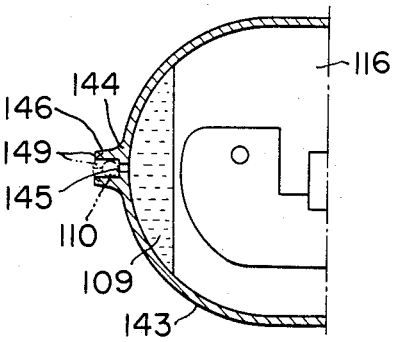
FIG. 25 is a partial sectional view, on enlarged scale, of the piezoelectric microphone as shown in FIG. 22, showing a method for sealing a viscous liquid in a case.

A brass case 143 is rectangular in cross section and has the upper and lower flat surfaces 142 (See FIG. 24). One end 144 of the brass case 143 is terminated into a plug receiving portion with a plug seat 145. The base 116 is inserted into the brass case 143 from the other end 148 thereof in such a way that the side surfaces of the base 116 are made into intimate contact with the inner surface of the brass case 143. Thereafter the cap 137 is inserted into the brass case 143 from the other end 148 thereof and then the other end 148 of the brass case 143 is calked so that the cap 137 is securely held in position. The other end 148 of the case 143 and the cap 137 are partially joined to each other by soldering and an adhesive is filled into the space between the other end 148 of the case 143 and the cap 137 so that the case 143 can be liquid-tightly sealed.

The case 143 is maintained in such a way that the plug receiving portion 146 is directed upwardly. Thereafter a viscous liquid 109 is filled into the case 143. A plug 110 is placed on and pressed against the plug seat 145 of the plug receiving portion 146 and thereafter the leading end 149 of the plug receiving portion 146 is closed, whereby the case 143 is liquid-tightly sealed.

Figure 26:
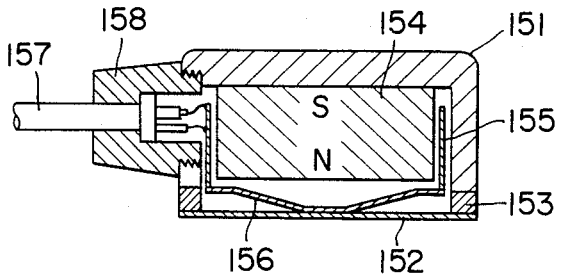
FIGS. 26 and 27 are sectional views, respectively, of a moving-coil microphone used in the present invention.
Figure 27:
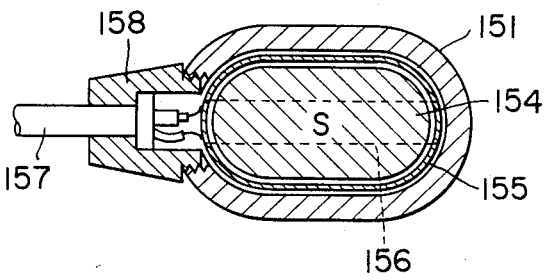

A further embodiment of the present invention is shown in FIGS. 26 and 27. The microphone shown is of the moving coil type. A magnetic case 151 is made of Permalloy (trademark) or pure iron. A diaphragm 152 which is made of brass or bronze is mounted through dampers 153 on the case 151. A magnet 154 is disposed within the base 151 and a moving coil 155 is disposed within the magnetic gap between the case 151 and the magnet 154 and is connectd to the diaphragm 152 by means of a coil supporting plate 156 which is made of brass or bronze. Both ends of the moving coil 155 are connected to a cord 157 which is mounted in the case 151 through a bushing 158.

The diaphragm 152 is pressed against the skin so that vibration transmitted through bones is transmitted to the diaphragm 152. The vibration of the diaphragm 152 is transmitted to the moving coil 155 so that the voltage signal is induced across the moving coil 155. Further description of the mode of operation of the moving coil type microphone shall not be made in this specification because it is well known to those skilled in the art.

Figure 28:
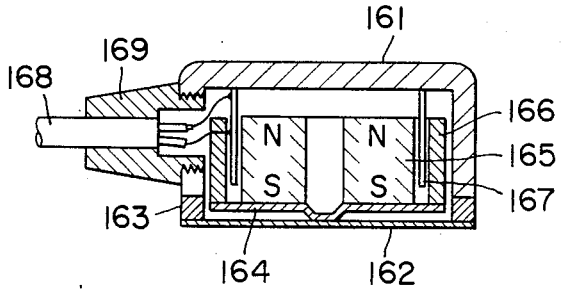
FIG. 28 is a sectional view of a moving-magnet microphone used in the present invention.

In FIG. 28 is shown an embodiment of a moving-magnet microphone used in the present invention. A diaphragm 162 is mounted through dampers 163 on a case 161 which is made of a nonmagnetic material. A retaining plate 164 which is made of a magnetic material is mounted on the diaphragm 162 and a permanent magnet 165 and a magnetic core 166 are mounted on the retaining plate 164. A stationary coil 167 is disposed within the magnetic gap defined between the permanent magnet 165 and the core 166. The stationary coil 167 is mounted on the case 161. Both ends of the stationary coil 167 are connected to a cord 167 which in turn is mounted on the case 161 through a bushing.

The mode of operation of the moving-magnet microphone of the type described is substantially similar to that of the moving-coil microphone described above with reference to FIGS. 26 and 27 so that no further description shall be made in this specification.

Figure 29:
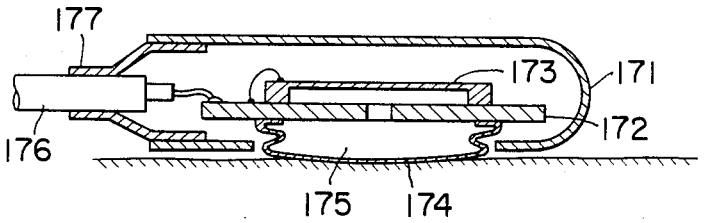
FIG. 29 is a sectional view of a microphone which is used in the present invention and which utilizes a pressure responsive type semiconductor element; that is, a pressure transducer type microphone.

In FIG. 29 is shown a further embodiment of the microphone used in the present invention. The microphone uses the so-called pressure-sensitive semiconductor element. A base 172 made of a material having a suitable coefficient of thermal expansion is disposed within a case 171 and a diaphragm 173 which is made of a semiconductor is mounted on the base 172. The diaphragm 173 is prepared by etching an n type silicon with a few millimeters on side in such a way that the center portion of the silicon substrate becomes a few microns or tens microns. Such thin center portion vibrates in response to the audio signal. A boron is diffused into the diaphragm 173 so as to provide a p-type resistor layer which is used as a strain gage. Two p-type resistor layers are formed at the center portion of the diaphragm 173 while two p-type resistor layers are formed around the periphery of the diaphragm 173. That is, the four p-type resistor layers are formed. It is preferable that the base 172 upon which is mounted the diaphragm 173 be made of silicon or pylex glass which has a coefficient of thermal expansion substantially equal to that of the n-type silicon substrate described above.

On the opposite side of the diaphragm 173, a bellows 174 is mounted. A pressure generating chamber 175 is defined between the base 172 and the bellows 174 and is communicated with the diaphragm 173 through a hole formed through the base 172 so that the variations in pressure in the pressure chamber 175 may be transmitted to the diaphragm 173.

The bridge circuit on the diaphragm 173 is connected to a cord 176 which is mounted on the case 171 through a bushing 177.

In use, the bellows 174 is made into contact with the skin so that the variations in pressure caused in response to the audio signal transmitted through bones are transmitted to the diaphragm 173. As a result, the voltage signal is derived from the bridge circuit as the diaphragm 173 vibrates.

What is claimed is:

1. A pickup device for picking up vibration transmitted through bones comprising:

an eyeglass-like assembly having a face-opposing member which is placed in front of a human face, a pair of supporting members one end of each of which is connected to each end of said face-opposing member and at least one nosepiece which is made into intimate contact with at least one upper side portion of the nose;

a microphone which is mounted on said face-opposing member at a suitable position for directly picking up the audio signal transmitted through bones as the solid vibration through said at least one nosepiece from said at least one upper side portion of the nose and for converting the picked up audio signal into an electrical signal; and a flexible cord one end of which is connected electrically to said microphone and whose one portion is supported by said eyeglass-like assembly at least at one portion thereof.

2. A pickup device for picking up vibration transmitted through bones as set forth in claim 1, wherein said microphone serves as one of said nosepieces.

3. A pickup device for picking up vibration transmitted through bones as set forth in claim 1, wherein said microphone is attached to one of said nosepieces.

4. A pickup device for picking up vibration transmitted through bones as set forth in claim 1, wherein said microphone is mounted on said face-opposing member.

5. A pickup device for picking up vibration transmitted through bones as set forth in claim 1, wherein said microphone is mounted on an auxiliary member which in turn is mounted on said face-opposing member through vibration damping member.

6. A pickup device for picking up vibration transmitted through bones as set forth in claim 1, wherein said microphone is mounted on said supporting member.

7. A pickup device for picking up vibration transmitted through bones as set forth in claim 1, wherein said microphone is attached to a soft pad which in turn is attached to one of said nosepieces.

8. A pickup device for picking up vibration transmitted through bones as set forth in claim 1, wherein said mocrophone is mounted through a vibration damping member on one of said nosepieces.

9. A pickup device for picking up vibration transmitted through bones as set forth in claim 1, wherein said microphone is piezoelectric microphone.

10. A pickup device for picking up vibration transmitted through bones as set forth in claim 9, wherein a piezoelectric element of said piezoelectric microphone is partially or totally immersed in a viscous liquid.

11. A pickup device for picking up vibration transmitted through bones as set forth in claim 9, wherein a weight is mounted on a suitable portion of a piezoelectric element of said piezoelectric microphone.

12. A pickup device for picking up vibration transmitted through bones as set forth in claim 9, wherein a piezoelectric element of said piezoelectric microphone is partially or totally supported by said vibration damping member.

13. A pickup device for picking up vibration transmitted through bones as set forth in claim 1, wherein said microphone is a moving-coil microphone.

14. A pickup device for picking up vibration transmitted through bones as set forth in claim 1, wherein said microphone is a moving-magnet microphone.

15. A pickup device for picking up vibration transmitted through bones as set forth in claim 1, wherein said microphone is of a pressure transducer type.

16. A pickup device for picking up vibration transmitted through bones as set forth in claim 1, wherein said cord is held by holding member extended from said face-opposing member.

17. A pickup device for picking up vibration transmitted through bones as set forth in claim 1, wherein said cord is held by one of said supporting members at a position adjacent to said face-opposing member, and one end of said cord opposite from the end connected to said microphone is set free.

18. A pickup device for picking up vibration transmitted through bones as set forth in claim 15, wherein at least one portion of said cord extended between said microphone and said holding member extended from said face-opposing member is embedded in said face-opposing member.

* * * * *